United States Patent [19]

Peterson

[11] Patent Number: 4,846,754

[45] Date of Patent: Jul. 11, 1989

[54] TOY WITH TIPPING LOAD CARRIER

[75] Inventor: Ingvar Peterson, Killeberg, Sweden

[73] Assignee: Brio AB, Osby, Sweden

[21] Appl. No.: 148,063

[22] Filed: Jan. 25, 1988

[30] Foreign Application Priority Data

Jan. 28, 1987 [SE] Sweden ..... 8700335

[51] Int. Cl.[4] ..... A63H 17/06; B62B 1/00; B60P 1/30; B60P 1/04

[52] U.S. Cl. ..... 446/428; 280/79.7; 298/18; 298/13

[58] Field of Search ..... 446/428, 427, 95; 280/79.1 A, 79.1 R; 105/65, 238.1, 238.2, 27; 296/184, 1 B; 298/18, 11, 1 C, 15 G, 1 V, 13, 17.5, 17 R

[56] References Cited

U.S. PATENT DOCUMENTS

| | | | |
|---|---|---|---|
| 1,354,111 | 9/1920 | Kosenko | 298/18 |
| 1,532,666 | 4/1925 | Wajer et al. | 446/428 |
| 1,621,871 | 3/1927 | Burner et al. | 105/270 |
| 1,631,241 | 6/1927 | Burner et al. | 105/270 |
| 1,672,041 | 6/1928 | Schmohl et al. | 105/270 |
| 2,277,455 | 3/1942 | Rexford | 105/238.2 X |
| 2,313,335 | 3/1943 | Godfrey | 446/428 X |
| 2,339,940 | 1/1944 | Noros | 280/79.1 RX |
| 2,889,172 | 6/1959 | Hoff | 294/184 X |
| 3,260,013 | 7/1966 | Ryan | 105/238.2 X |
| 3,662,488 | 5/1972 | Linstead | 446/428 |
| 4,060,931 | 12/1977 | Knott | 446/428 X |
| 4,685,859 | 8/1987 | Marshall, Jr. | 280/79.1 A X |

FOREIGN PATENT DOCUMENTS

| | | | |
|---|---|---|---|
| 673528 | 6/1952 | United Kingdom | 446/428 |

*Primary Examiner*—Robert A. Hafer
*Assistant Examiner*—D. Neal Muir
*Attorney, Agent, or Firm*—Barnes, Kisselle, Raisch, Choate, Whittemore & Hulbert

[57] ABSTRACT

A toy has a body and a tipping load carrier which is rotatably mounted in the body about a horizontal axis for rotation between a load-receiving position and at least one tipping position. The body has a planar upper surface portion. The load carrier has a planar lower surface portion with which the load carrier, when in its load-receiving position, is resting on the planar upper surface portion of the body. Each of two mutually aligned pivot pins defining said axis is fixed to one of the load carrier and the body. The pivot pins are mounted each in a vertically elongate hole which is formed in the other of the load carrier and the body.

3 Claims, 1 Drawing Sheet

TOY WITH TIPPING LOAD CARRIER

The present invention relates to a toy having a body and a tipping load carrier which is rotatably mounted in the body about a horizontal axis for rotation between a load-receiving position and at least one tipping position.

BACKGROUND OF THE INVENTION

The invention relates in particular to a toy wagon in which the body is part of the wagon proper and the axis extends in the longitudinal direction of the wagon.

In a known toy railway wagon of this type which is intended for use in a wooden toy railway, the tipping load carrier consists of a container which is rotatably and freely suspended in a front and a rear end wall member fixed to the body. The container has two mutually aligned pivot pins which define said axis and are inserted in circular holes in the front and the rear end wall member. The diameter of the holes insignificantly exceeds that of the pivot pins.

Since the container is freely suspended from the end wall members, it is relatively unstable when in its load-receiving position or resting position. This means that it will tip very easily when it is being loaded, e.g. with sand, and the load is not completely evenly distributed in the container. Thus, children playing with the wagon will easily be annoyed by its instability and lose interest in playing with it.

The object of the present invention therefore is to provide a toy, especially a toy wagon, in which the tipping load carrier is stable when in its load-receiving position, but yet maintains a simple tipping function.

SUMMARY OF THE INVENTION

According to the invention, this object is achieved by a toy which is of the type mentioned in the introduction to this specification, which is characterized in that the body has a planar upper portion, that the load carrier has a planar lower portion with which the load carrier, whenin its load-receiving position, is resting on the planar upper portion of the body, that each of two mutually aligned pivot pins defining said axis is fixed to one of the load carrier and the body, and that the pivot pins are each mounted in a vertically elongate hole formed in the other of the load carrier and the body.

In a preferred embodiment, the planar upper portion of the body is a planar upper surface and the planar lower portion of the load carrier is a planar bottom surface.

Preferably, the two pivot pins are fixedly connected to the load carrier, and the two holes are formed in two opposite portions of the body between which the load carrier is disposed.

In a special embodiment, the toy is a toy wagon in which the body is part of the wagon proper and the axis extends in the longitudinal direction of the wagon.

BRIEF DESCRIPTION OF THE DRAWINGS

The invention will now be described in more detail with reference to the accompanying drawing, in which.

DESCRIPTION OF THE PREFERRED EMBODIMENTS

Figure 2:
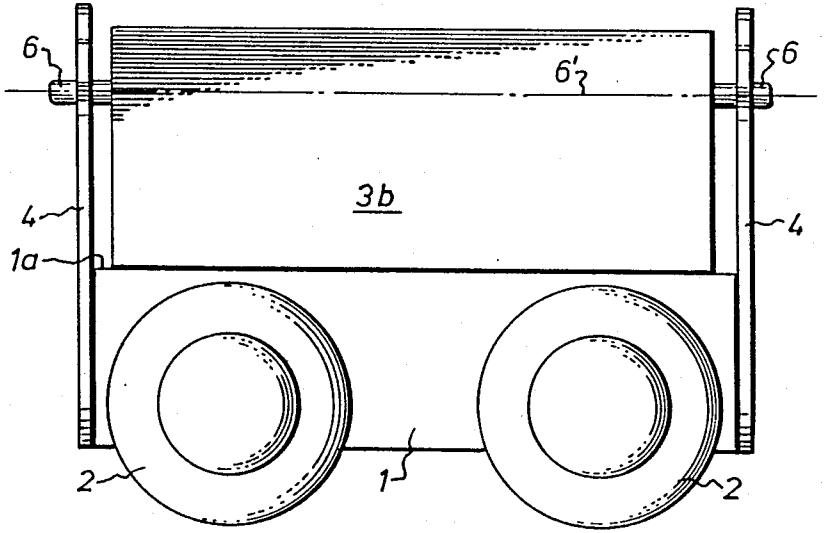
FIG. 2 shows the toy wagon of FIG. 1 from the side.

The toy wagon shown in the drawing is intended for use in a wooden toy railway and has a body 1, four wheels 2 fixed to the body, and a tipping load carrier 3 supported by the body. The load carrier 3 is a container having an externally planar horizontal bottom surface 3*a*, outwardly inclined side walls 3*b* and two vertical end walls 3*c*. The body 1 has a planar, horizontal upper surface 1*a* on which the container 3, when its resting or load-receiving position, as illustrated in the drawing, rests with its planar bottom surface 3*a*. In this manner, the container 3 will rest stably on the body 1 when in this position and will not tip in the case of a moderate loading unbalance. The broader the engagement surface is between the planar bottom surface 3*a* of the container 3 and the planar upper surface 1*a* of the body 1, the more stably will the container of course rest on the body.

Figure 1:
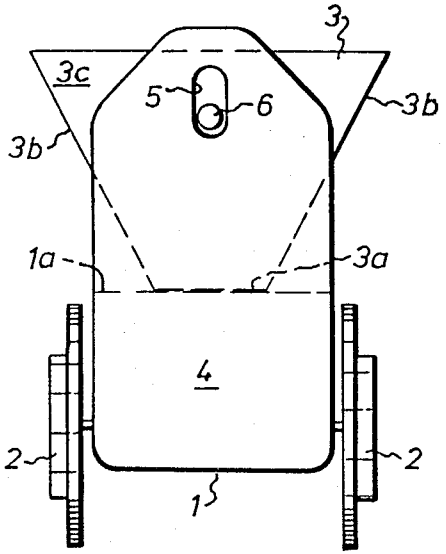
FIG. 1 shows a toy wagon from behind.

The body 1 has two vertical end wall members 4 each having a vertically elongate hole 5. The end walls 3*c* of the container 3 each have a horizontally projecting pivot pin 6 fixedly connected thereto and received in the hole 5 of the corresponding end wall member 4. The pivot pins 6 are aligned with each other and define the axis of rotation 6' of the container 3. The diameter of the pivot pins 6 is slightly smaller than the width of the holes 5, but considerably smaller than the vertical extent of the holes, which clearly appears from FIG. 1. The holes 5 and the pivot pins 6 are so located in relation to each other that the pivot pins 6, as illustrated in FIG. 1, are positioned in the lower portion of the respective hole 5 when the container 3 is in its resting or load-receiving position.

Thus, the container 3 is rotatable both to the right and to the left, to a right-hand and a left-hand tipping position, respectively. The container 3 is rotated by hand. In order to rotate the container 3 to a tipping position, the pivot pins 6 are first raised in the holes 5, which is possible because of the vertically elongate shape thereof. When the righthand, longitudinal edge of the planar bottom surface 3*a* (upon rotation to the right) or the left-hand, longitudinal edge (upon rotation to the left) has passed a position straight underneath the axis of rotation 6' defined by the pivot pins 6, the pivot pins 6 are again lowered in the holes 5 during the continued rotation of the container 3 up to the tipping position.

The invention is of course not restricted to the embodiment described above and shown in the drawing but may be modified in several different ways within the spirit and scope of the accompanying claims. Thus, in a conceivable alternative embodiment it is possible, for instance, to fix the pivot pins 6 to the end wall members 4 of the body 1 and to form the vertically elongate holes 5 in the end walls 3*c* of the container 3. Further, it is possible to arrange one pair consisting of pivot pin 6 and hole 5 in the manner shown in the drawing and the other pair consisting of pivot pin 6 and hole 5 in the alternative manner. Further, the function performed by the planar upper surface 1*a* of the body 1 can be achieved by means of a planar upper portion formed e.g. of a number of transverse ribs. Similarly, the function performed by the planar bottom surface 3*a* of the container 3 can be achieved by a planar lower portion formed e.g. of two or more longitudinal ribs, the distance between the outermost ribs being decisive of how stably the container 3 will rest on the body 1 when in its load-receiving position.

I claim:

1. A toy having a body and a tipping load carrier comprising a planar bottom surface, said load carrier being rotatably mounted in the body about a horizontal axis for rotation between a load-receiving position and at least one tipping position, characterized in that the body has a planar upper surface with which the load carrier, when in its load-receiving position, is resting on said planar upper surface of the body, that each of two mutually aligned pivot pins defining said axis is fixed to one of the load carrier and the body, and that the pivot pins are mounted and guided each in a vertically elongate hole formed in the other of the load carrier and the body such that when said load carrier is rotated by hand, the load carrier is first raised with respect to said body, the pivot pins are moved within said vertically elongate holes and when an edge of the planar bottom surface has passed a position beneath the axis of rotation defined by the pivot pins, the load carrier is again lowered with respect to said body during the continued rotation of the container to the tipping position.

2. Toy as claimed in claim 1, characterized in that the two pivot pins are fixedly connected to the load carrier and that the two holes are formed in two opposite portions of the body between which the load carrier is disposed.

3. Toy as claimed in any one of claims 1 or 2, characterized in that the body is part of a toy wagon having a longitudinal dimension and that said axis extends in said longitudinal dimension of the wagon.

* * * * *